United States Patent [19]

Yanagi et al.

[11] Patent Number: 4,498,403

[45] Date of Patent: Feb. 12, 1985

[54] PROGRAMMING DEVICE FOR AN AUTOMATIC SEWING MACHINE

[75] Inventors: Toshiaki Yanagi; Yoshinori Bessho, both of Nagoya, Japan

[73] Assignee: Brother Kogyo Kabushiki Kaisha, Nagoya, Japan

[21] Appl. No.: 407,799

[22] Filed: Aug. 13, 1982

[30] Foreign Application Priority Data

Aug. 31, 1981 [JP] Japan ..... 56-136746

[51] Int. Cl.³ ..... D05B 21/00

[52] U.S. Cl. ..... 112/121.12; 112/103

[58] Field of Search ..... 112/121.12, 102, 103, 112/158 E; 364/400, 470; 318/568

[56] References Cited

U.S. PATENT DOCUMENTS 4,222,339 9/1980 Iwako ..... 112/158 E 4,383,489 5/1983 Sugiyama et al. ..... 112/121.12

4,399,760 8/1983 Bergvall ..... 112/158 E

*Primary Examiner*—Peter Nerbun

*Attorney, Agent, or Firm*—Browdy and Neimark

[57] ABSTRACT

A programming device for an automatic sewing machine wherein a succession of stitches defining a stitch pattern are formed through relative movements between a needle and a work holder according to a batch of sewing instructions. The programming device comprises: a sewing instruction memory for storing the sewing instructions to form the stitch pattern; numeric keys for setting a desired number of angular divisions of a plane about a preset coordinate point into equal angles, the preset coordinate point being defined by a first sewing instruction stored in the memory; and a control circuit adapted to prepare, based on the stored sewing instructions, another batch of sewing instructions for forming the switch pattern at a plural number of positions corresponding to said desired number of angular divisions, the plural number of positions being circumferentially spaced about the preset coordinate point in every degree of said equal angles, and store the prepared another batch of sewing instructions in the sewing instruction memory.

6 Claims, 13 Drawing Figures

PROGRAMMING DEVICE FOR AN AUTOMATIC SEWING MACHINE

BACKGROUND OF THE INVENTION

The present invention relates to a programming device or system for a sewing machine capable of forming a succession of stitches or a stitch pattern or patterns on a workpiece under control of a batch of sewing instructions.

In the art of electronically-controlled sewing machines for industrial applications wherein a unit stitch pattern A as exemplified in FIG. 1 is formed in plural numbers as shown in FIG. 2 to provide a combination of the unit stitch patterns A (hereinafter referred to as "composite stitch pattern An) which are circumferentially disposed about a given point located at the center of formation, it has been a common practice in programming the composite stitch pattern An that sewing instructions for the stitch pattern An are prepared, with a cumbersome and time-consuming procedure, by tracing the profile of the pattern An while moving work holding means of the machine. More specifically, a prepared record medium on which the composite stitch pattern An is recorded is first retained on the work holding means. Then, the work holding means carrying the record medium is moved a stitch-to-stitch distance so that successive stitch positions of the pattern An on the rocord medium are sequentially brought into alignment with a needle position in the horizontal plane in order to prepare a sewing instruction for each of the stitches forming the composite pattern An. Thus, the sewing instructions necessary to create the composite stitch pattern An must be prepared by repeated movements of the work holding means to have the needle trace the pattern profile from one stitch to another for preparing the sewing instructions for all of the stitches.

As described above, the commonly practiced programming method or a device to practice the method in the art requires a lot of time and labor of the machine operator for preparing whole batch of sewing instructions, particularly where a desired stitch pattern includes a multiplicity of stitches like the composite stitch pattern An exemplified in FIG. 2. There exists a further shortcoming of such programming method and device that the stitch positions of the pattern An on the record medium must be exactly aligned with the needle position during preparation of the sewing instructions, otherwise a neat formation of the stitch pattern can not be obtained from the prepared sewing instructions.

SUMMARY OF THE INVENTION

It is accordingly an object of this invention to provide programming system and method for a sewing machine, which permits easy and efficient programming of a composite stitch pattern consisting of a plurality of unit stitch patterns which are disposed about a given center point in circumferentially equally spaced relation with one another.

Another object of the invention is to provide programming system and method for a sewing machine, which allow easy and efficient preparation of sewing instructions assuring a neat formation of such composite stitch pattern.

According to the present invention, there is provided a programming device or system for an automatic sewing machine wherein a succession of stitches defining a stitch pattern are formed through relative movements between a needle and a work holder according to a batch of sewing instructions, characterized in that said programming device comprises:

memory means for storing the batch of sewing instructions prepared for forming the stitch pattern;

manual setting means for setting a desired number of angular divisions of a plane about a preset coordinate point into equal angles, the preset coordinate point being defined by a first sewing instruction stored in the memory means;

first control means for preparing, based on the batch of sewing instructions, another batch of sewing instructions for forming the stitch pattern at a plural number of positions corresponding to the desired number of angular divisions, the plural number of positions being circumferentially spaced about the preset coordinate point in every degrees of the equal angles; and second control means for storing the another batch of sewing instructions in the memory means.

These and other objects and features of the invention will become more apparent from the following description of preferred embodiments thereof taken in connection with the accompanying drawings.

BRIEF DESCRIPTION OF THE DRAWINGS

The present invention is illustrated in the accompanying drawings in which.

DETAILED DESCRIPTION OF THE PREFERRED EMBODIMENTS

Referring now to the accompanying drawings, there will be described the present invention embodied on a sewing machine.

Figure 3A:
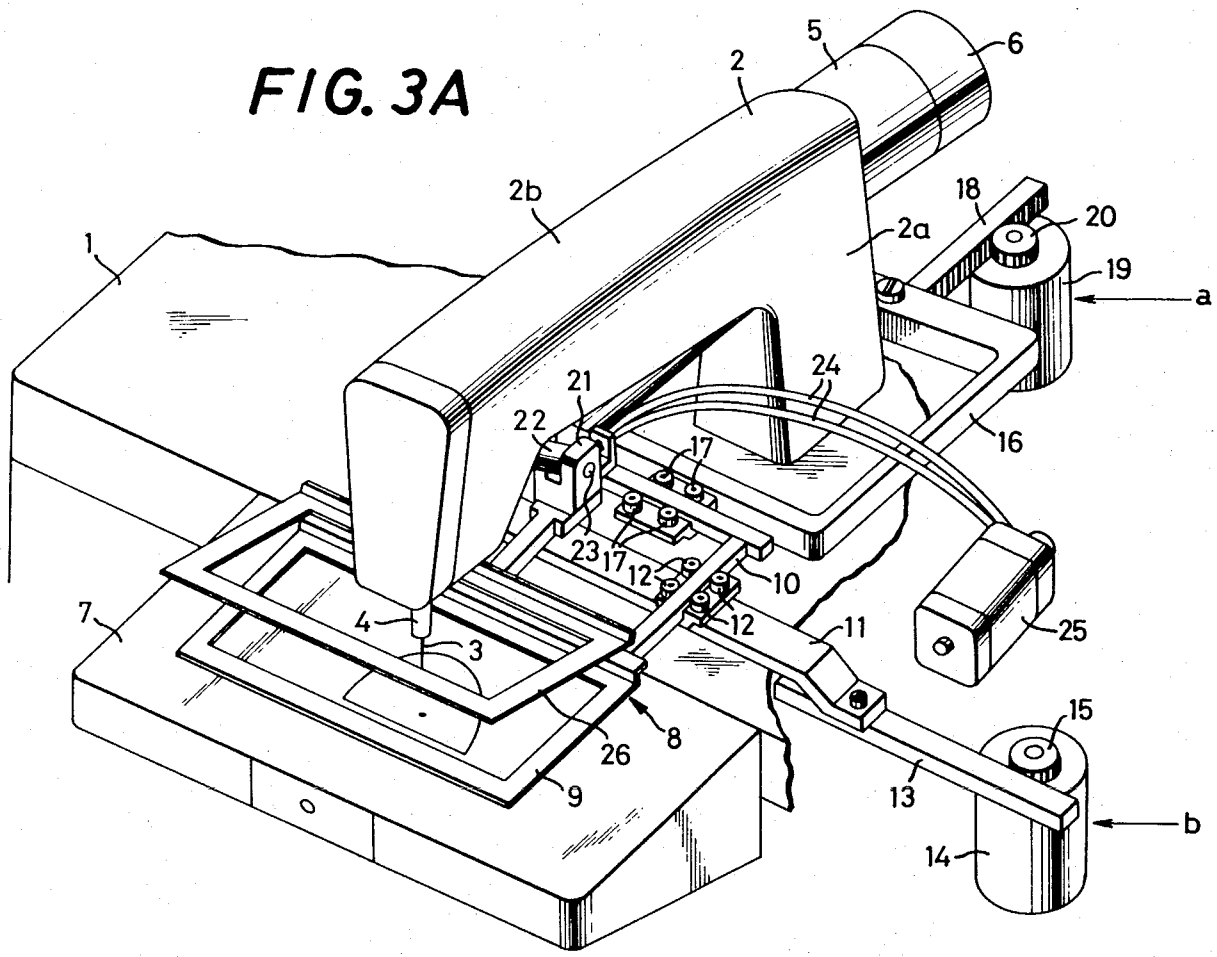
FIG. 3A is a fragmentary perspective view of a sewing machine.

There is shown in FIG. 3*a* a table 1 of the sewing machine on which is mounted a machine frame 2 which has a standard 2*a* and a bracket arm 2*b* extending toward the front of the machine. The bracket arm 2*b* includes a head portion which is provided with a vertically movable needle bar 4 having at its lower end a needle 3. The head portion is further provided with a vertically movable presser bar (not shown) having at its lower end a presser foot (not shown). There is mounted on the rear side of the bracket arm 2*b* a direct current (DC) drive motor 5 which provides vertical movements of the needle bar 4. Attached to the rear side of the DC drive motor 5 is a needle position detector 6 which detects an angular position, i.e., rotation of a drive shaft of the DC drive motor 5 and generates a detection signal each time the needle 3 is located at a predetermined position, e.g., lowered or lifted position.

There is provided, at the central front of the table 1, a workpiece support bed 7 on which is supported a work holder or holding device 8 which is movable in a horizontal plane across the reciprocating path of the needle 3. The needle 3 and a shuttle hook (not shown) incorporated in the workpiece support bed 7 cooperate to form stitches on a workpiece held by the work holding device 8.

The work holding device 8 comprises a work supporting frame 9 disposed on the workpiece support bed 7. The work supporting frame 9 is fixed at the rear to a feed frame 10 which is supported movably in both lateral (X) and cross (Y) directions, i.e., along the X and Y axes of the machine.

The feed frame 10 is operatively coupled to a connecting member 11 which is supported movably only in the lateral direction and which carries guide rollers 12 engaging two opposite sides of the feed frame 10. The guide rollers 12 permit the feed frame 10 to move in the cross direction. The connecting member 11 is connected, at its right-hand side end as viewed in FIG. 3, to a rack 13 which engages a pinion 15 fixed to a drive shaft of an X-axis pulse or stepper motor 14, whereby the feed frame 10 is moved, via the rack 13 and the connecting member 11, to the left as viewed in FIG. 3, i.e., in the positive X (+X) direction when the stepper motor 14 is operated in one direction, and to the right, i.e., in the negative X (−X) direction when it is operated in the other or reverse direction.

The feed frame 10 is operatively coupled further to a connecting frame 16 which is supported movably only in the cross (Y) direction and which carries guide rollers 17 engaging the rear side of the feed frame 10. The guide rollers 17 permit the feed frame 10 to move in the lateral (X) direction. The connecting frame 16 is connected, at its rear side, to a rack 18 which engages a pinion 20 fixed to a drive shaft of a Y-axis pulse or stepper motor 19, whereby the feed frame 10 is moved, via the rack 18 and the connecting frame 16, toward the rear, i.e., in the negative Y (−Y) direction when the stepper motor 19 is operated in one direction, and toward the front, i.e., in the positive Y (+Y) direction when it is operated in the other direction. With this construction, the forward and reverse rotation of the X-axis and Y-axis stepper motors 14 and 19 will cause the work supporting frame 9 to move in the lateral and cross directions thereby allowing any point within the supporting frame 9 to be brought into alignment with the needle 3 or located at a needle lowering position (hereinafter simply called "needle position") in the horizontal plane.

There is fixed to the feed frame 10 a block 21 which has a pivot arm 22 connected thereto pivotally about a support pin 23. The base or supported end portion of the pivot arm 22 is coupled to a drive motor 25 through two wires 24 so that the pivot arm 22 is pivoted via the wires 24 in upward and downward directions upon rotation of the drive motor 25 in opposite directions. To the free or distal end portion of the pivot arm 22, is operatively connected a presser frame 26 which has the same configuration and size as the work holder frame 9. The presser frame 26 cooperates with the work supporting frame 9 to retain the workpiece therebetween when the pivot arm 22 is pivoted downwardly.

There is described next an electric circuit of a programming system of the invention provided on the above sewing machine.

Figure 3B:
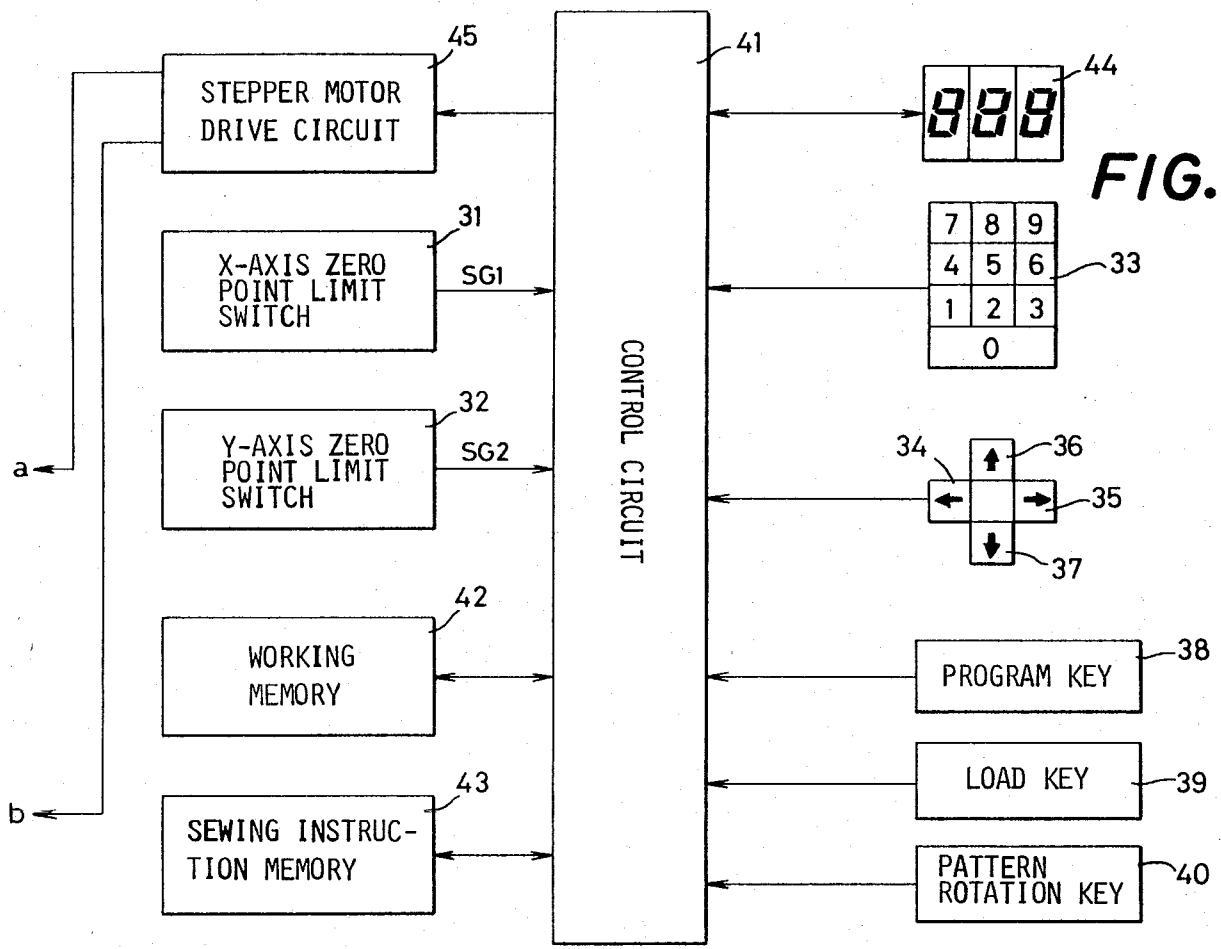
FIG. 3B is a block schematic diagram of a control circuit.

In FIG. 3B, there is shown an X-axis zero point limit switch 31 which is disposed in the proximity of a reciprocating motion path of the previously described rack 13. The limit switch 31 generates an ON signal upon engagement of its movable actuator piece with the rack 13 when the inner edge of the left-hand side of the work supporting frame 9 (as viewed in FIG. 3A) is located at the needle position as a result of a rightward movement of the rack 13 by the X-axis stepper motor 14. Similarly, a Y-axis zero point limit switch 32 is disposed in the proximity of a reciprocating motion path of the previously described rack 18. The limit switch 32 generates an ON signal upon engagement of its movable actuator piece with the rack 18 when the inner edge of the rear side of the work supporting frame 9 is located at the needle position as a result of a forward movement of the rack 18 by the Y-axis stepper motor 19. Numeric keys 33; [0] through [9] are disposed on a program control console (not shown) provided on the sewing machine. These keys 33 are automatically resettable and used to set a desired number of pre-programmed same unit stitch patterns which are to be formed about a predetermined point in a horizontal plane or X-Y coordinate system such that the plural unit patterns are equally spaced circumferentially of the circle. In other words, those numeric keys 33 are used to set a desired number of angular divisions of the circle (360°) into equal angles to determine an angular spacing from one unit stitch pattern to another when the already programmed unit stitch pattern or the same stitch pattern defined by prepared stitch instructions is provided in plural numbers to obtain a composite stitch pattern. When each of the numeric keys 33 is pressed, a corresponding code signal is produced.

There are also provided, on the program control console, X- and Y-axis jog keys 34, 35, 36 and 37 which are automatically resettable and produce, when pressed, pulse signals to move the work holding device 8 in corresponding directions. More specifically, pressing one of the X-axis jog keys 34 will cause the work holding device 8 to move to the left as seen in FIG. 3A. On the other hand, pressing the other X-axis jog key 35 will cause the same device 8 to move to the right. Similarly, the device 8 is moved toward the rear when one of the Y-axis jog keys 36 is pressed, while it is moved toward the front when the other Y-axis jog key 37 is pressed.

The program control console further provides a program key 38 which is also automatically resettable and is used to start programming a unit stitch pattern or programming the sewing instructions. When the key 38 is pressed, an ON signal is generated. There is also provided on the program control console an automatically resettable load key 39 which, when pressed, produces an ON signal that causes a later described working memory 42 to store sewing instructions associated with each stitch position and feed instructions, both kinds of instructions being established by manipulating the X- and Y-axis jog keys 34 through 37.

A pattern rotation key 40 provided also on the program control console is automatically resettable and used when preparing another kind of instructions (composite pattern arrangement instructions) to form the unit stitch pattern (which is pre-programmed and defined by the previously indicated instructions) at plural positions rotated about the predetermined center point such that the plural unit stitch patterns are disposed in circumferentially spaced relation with one another in every predetermined degrees of angles to obtain a composite stitch pattern which is a combination of the identical unit stitch patterns. When the pattern rotation key 40 is pressed, an ON signal is produced and supplied to a control circuit 41.

The control circuit 41 designed as control means receives the outputs of the ON signals and code signals from the respective limit switches and keys 31 through 40. and are adapted to control the following operations according to those signals: preparation of the stitch instructions by moving the work holding device 8 carrying a record medium on which is recorded a desired unit stitch pattern; preparation of said another kind of instructions to form the pre-programmed unit stitch patterns in circumferentially equally spaced relation with one another as described above; and operation of the sewing machine according to those kinds of instructions prepared.

Figure 4:
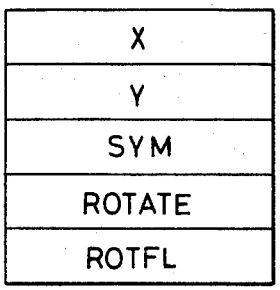
FIG. 4 is a view showing data storage areas of a working memory connected to the control circuit.

The working memory 42 is a random access memory which has the following memory areas as indicated in FIG. 4: an area in which is stored data X representative of the number of steps of the X-axis stepper motor 14 obtained during an operation thereof by manipulating the X-axis jog keys 34 and 35 (a distance of lateral movement of the work holding device 8); an area in which is stored data Y representative of the number of steps of the X-axis stepper motor 19 obtained during an operation thereof by manipulating the Y-axis jog keys 36 and 37 (a distance of cross movement of the work holding device 8); an area in which is stored data SYM representative of rotating directions of the X- and Y-axis stepper motors 14 and 19 (positive or negative direction in which the work holding device 8 is moved along the X and Y axes); an area in which is stored data ROTATE representative of the number of unit stitch patterns to obtain a composite stitch pattern (number of angular divisions of 360°) selected by manipulating the numeric keys 33; and an area in which is stored data ROTFL representing whether the pattern rotation key 40 has been actuated or not.

There is provided a sewing instruction memory 43 designed as memory means which is also a random access memory, at the addresses of which are sequentially stored sewing instructions associated with each of the stitches forming a unit stitch pattern. The sewing instructions include the data representative of the number of steps of the X- and Y-axis stepper motors 14 and 19, rotating directions thereof, and data commanding the work holding device 8 to move in the lateral and cross directions while the DC drive motor 5 is in operation or at rest (the data commanding the device 8 to move with the DC drive motor 5 kept at rest, is referred to an "feed instructions" for convenience of description.).

An indicator device 44 indicates, on a seven-segment, three-digit display, numerical values corresponding to the numeric keys 33 that are actuated, and at the same time stores those values. When the pattern rotation key 40 is actuated, the numerical values stored in the device 44 are transferred to the working memory 42 and stored therein as the data ROTATE representing the number of unit stitch patterns or said angular divisions. A stepper motor drive circuit 45 directs the X- and Y-axis stepper motors 14 and 19 to operate a selected number of steps in a selected direction in response to the drive control signals generated from the control circuit 41.

Referring to FIGS. 5 through 11 which are flow charts associated with the control circuit 41, the operation of the sewing machine constructed as previously disclosed will be described.

Figure 5:
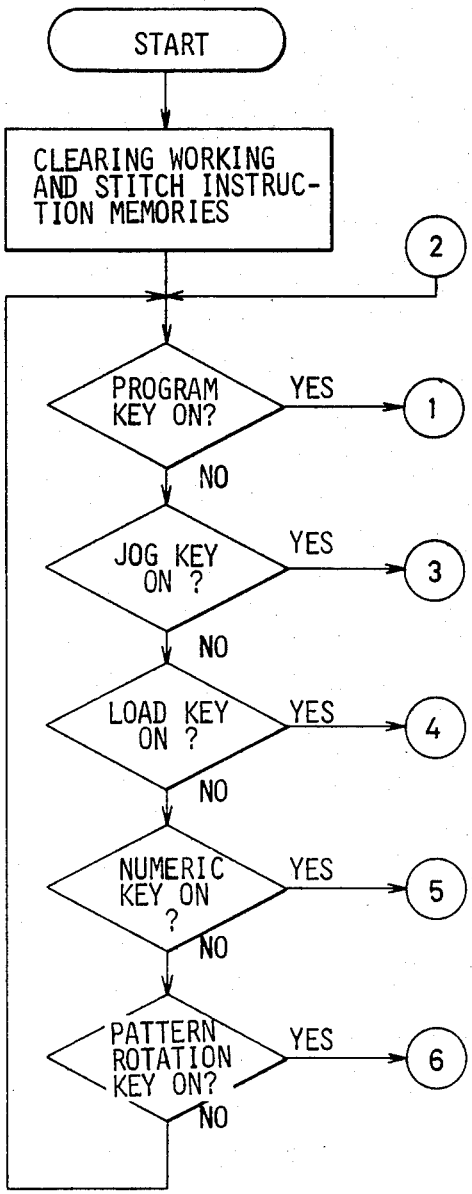
FIGS. 5 through 11 are flow charts representing operations of the control circuit.
Figure 6:
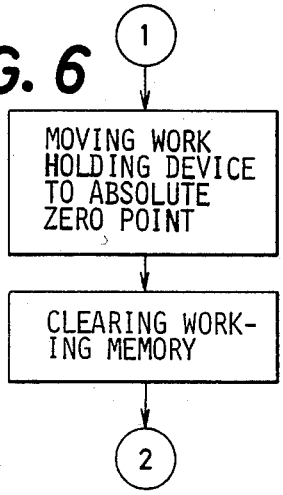

When a power on-off switch (not shown) of the sewing machine is turned on, the control circuit 41 will operate in the sequence as shown in the flow chart of FIG. 5. Upon power application to the machine, the working memory 42 and the sewing instruction memory 43 are fully cleared and the control circuit 41 becomes ready to receive the outputs of the various control keys 33 through 44, i.e., the circuit 41 will wait for operation of those keys for programming a unit stitch pattern or preparing sewing instructions to form that unit stitch pattern according to a desired unit stitch pattern recorded on a record medium, and wait for subsequent operation of the keys for preparing another kind of instructions (composite pattern arrangement instructions) to form the pre-programmed unit stitch pattern in plural numbers with respect to a center point in circumferentially equally spaced relation with one another.

Figure 1:
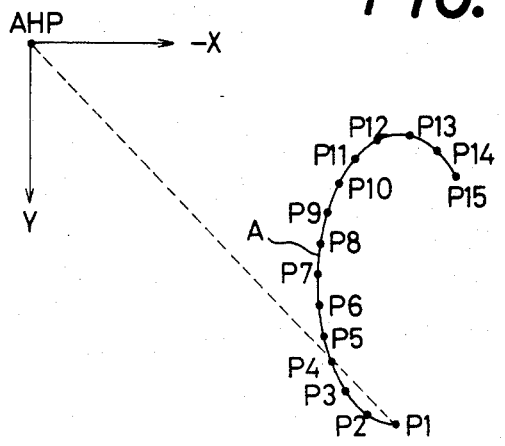
FIGS. 1 and 2 are views of a unit stitch pattern and a composite stitch pattern, respectively, explaining the present invention.

To program a unit stitch pattern A recorded on the record medium shown in FIG. 1, the machine operator first holds the record medium on the work holding device 8 and then turns on the program key 38. As soon as the program key 38 is turned on, the control circuit 41 produces the drive control signals, which are received by the stepper motor drive circuit 45 to operate the X- and Y-axis stepper motors 14 and 19 such that the work holding device 8 is moved to the absolute zero point AHP (such that the left rear corner of the work holder frame 9 is located at the needle position), as indicated in the flow chart of FIG. 6. When the work holding device 8 has reached the absolute zero point AHP, the X- and Y-axis limit switches 31 and 32 are both turned on and generate the ON signals which cause the control circuit 41 to produce the drive control signals for stopping the work holding device 8, clear the working memory 42, and become ready to accept the output of the control keys.

Figure 7:
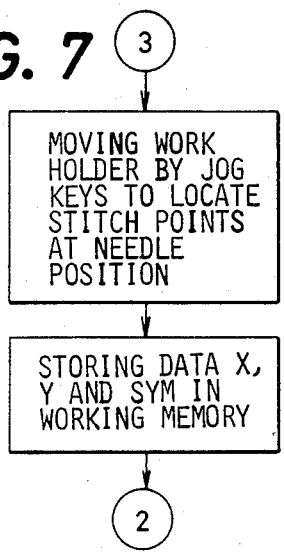

When the appropriate jog keys 34–37 are operated to move the work holding device 8 for establishing alignment of the first stitch point P1 on the pattern A on the record medium with the needle position, the control circuit 41 will operate in the sequence as shown in the flow chart of FIG. 7, so that the X- and Y-axis stepper motors 14 and 19 are each operated by a required number of steps in the selected direction to align the stitch point P1 with the needle position. The obtained data X and Y (numbers of steps of the motors 14 and 19) and SYM (rotating directions of the motors) are stored in the respective areas of the working memory 42. Then, the control circuit 41 will wait for operation of the load key 39.

Figure 8:
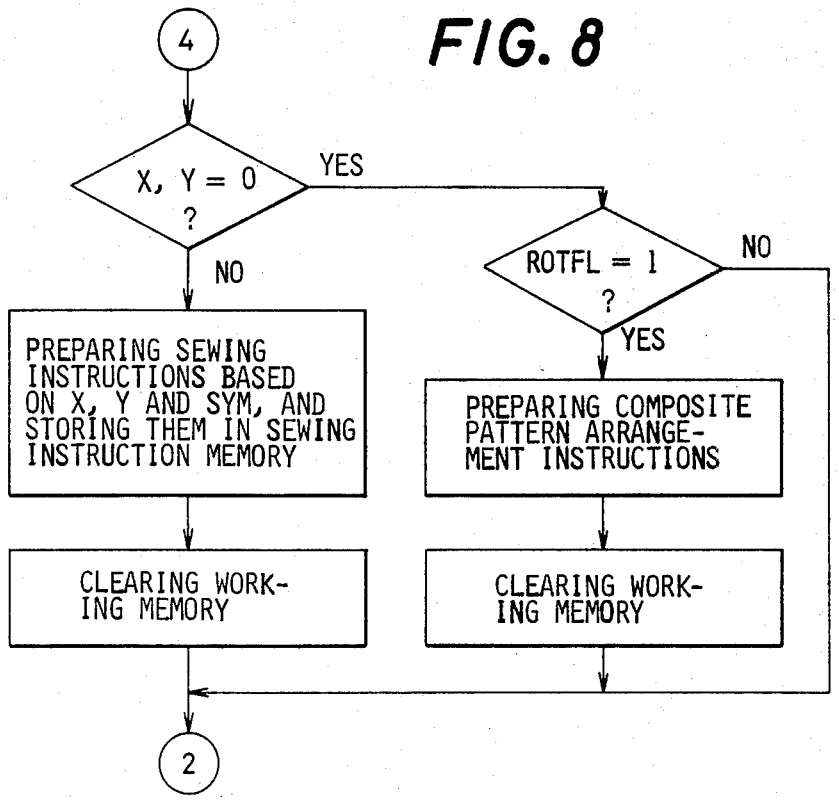
Figure 9:
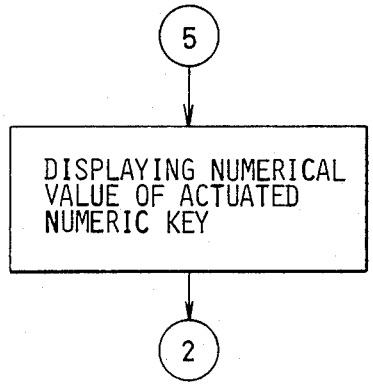
Figure 10:
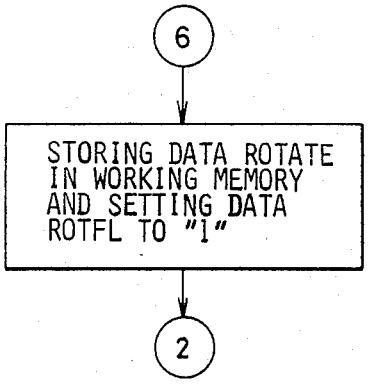

Upon turning on the load key 39, the control circuit 41 will operate in the sequence as shown in the flow chart of FIG. 8. At first, the control circuit 41 judges whether the data X and Y of the stepper motors 14 and 19 are stored in the working memory 42 and, if they are stored therein, prepares a sewing instruction of the stitch point P1 according to the data X, Y and SYM and stores the prepared sewing instructions at the appropriate addresses of the sewing instruction memory 43. Then, the control circuit 41 will clear the working memory 42 and wait for operation of the control keys to prepare sewing instructions of the next stitch point P2. In the same manner, the control circuit 41 repeats to prepare sequentially sewing instructions of the stitch points P2 through P15 and store them at the respective addresses of the sewing instruction memory 43.

Figure 2:
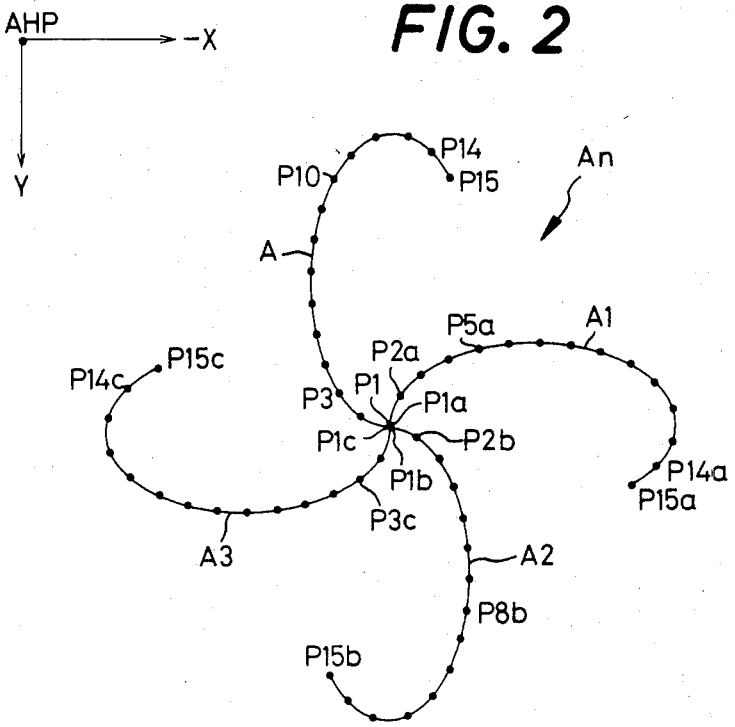

After all of the stitch points P1 through P15 on the stitch pattern A shown in FIG. 1 have been programmed, that is, after the sewing instructions of all the stitch points have been prepared, the operator then proceeds with the pre-preparation of another kind of instructions (Composite pattern arrangement instructions) to form, for example, three additional stitch patterns A1 through A3 identical to the pre-programmed unit stitch pattern A, so that all of the stitch patterns A and A1 through A3 are disposed about the first stitch point P1 at the respective positions which are rotated in every 90° about the point P1 located at the center of the arrangement to form a composite stitch pattern An, as shown in FIG. 2. In this case, therefore, the numeric key "4" 33 is pressed to set the data ROTATE at "4" and as a result, the control circuit 41 causes the indicator device 44 to display the numerical value "4" on its display as shown in the flow chart of FIG. 9.

When the pattern rotation key 40 is turned on, the control circuit 41 causes the working memory 42 to store, at its appropriate memory area, the data ROTATE "4" displayed on the display, and establishes the numerical value "1" at the memory area of the memory 42 which is assigned to store the data ROTFL representing whether the pattern rotation key 40 has been turn on or off. (See the flow chart of FIG. 10.) Then, the control circuit 41 waits for operation of the load key 39.

Figure 11:
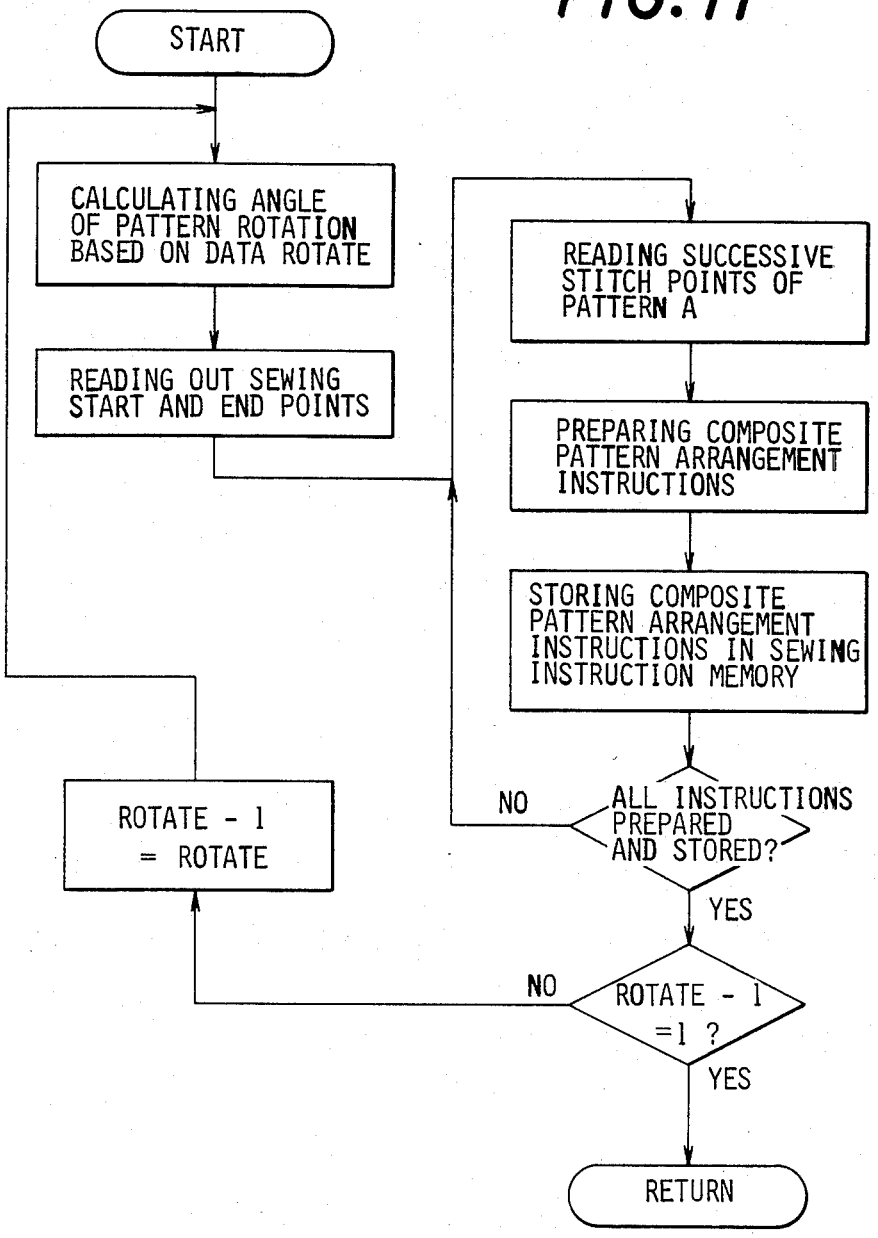

Successively, as shown in the flow chart of FIG. 8, the operation of the load key 39 will cause the control circuit 41 to judge that the data X and the data Y in the respective areas of the working memory 42 are both "0" and that the data ROTFL is "1", and then the circuit 41 proceeds to prepare the sewing instructions (composite pattern arrangement instructions), in the sequence shown in the flow chart of FIG. 11, to arrange the three stitch patterns A1–A3 with equal angular spacings (90°) as described before.

The control circuit 41 calculates the angle of pattern rotation (90°) based on the data ROTATE (representing the number of angular divisions) stored in the working memory 42 and at the same time reads out from the sewing instruction memory 43 the sewing instructions of the stitch points P1 (stitching start position) and P15 (stitching end position) which are previously programmed. Successively, the circuit 41 begins to prepare the sewing instructions for forming the stitch patten A1 identical to the stitch pattern A at a position which is rotated 90° in the clockwise direction about the stitch point P1 from the position of the stitch pattern A. At first, the circuit 41 prepares a sewing instruction of the stitch point P1*a* of the stitch pattern A1 corresponding to the stitch point P1 of the stitch pattern A, based on the sewing instruction of the stitch point P1 and the data representative of the angle of pattern rotation (90°). In this instance, the obtained sewing instruction of the stitch point P1*a* is the same as that of the point P1 because the sewing start point P1*a* of the stitch pattern A1 is located at the stitch point P1 of the stitch pattern A, and stored in the appropriate address of the sewing instruction memory 43. Then, the sewing instruction of the stitch point P2*a* is prepared based on the instruction of the stitch point P2 and the angle of rotation (90°), and stored in the appropriate address of the memory 43. Similarly, the sewing instructions of the stitch points P3*a* through P15*a* are sequentially prepared and stored in the sewing instruction memory 43.

After the sewing instructions of all the stitch points P1*a*–P15*a* of the stitch pattern A1 have been prepared, the control circuit 41 will substract "1" from the data ROTATE in the working memory 42 and thus newly establish the numeral value "3" as the data ROTATE. Successively, the sewing instructions of the stitch points P1*b*–P15*b* of the stitch pattern A2 which is formed at a position rotated 180° clockwise with respect to the stitch pattern A, are prepared in the same manner as described above. The same steps are repeated to prepare the sewing instructions of the stitch points P1*c*–P15*c* of the stitch pattern A3 which is formed at a position rotated 270° clockwise with respect to the stitch pattern A.

When the sewing instructions of the stitch patterns A1–A3 have been prepared and stored in the sewing instruction memory 43, the control circuit 41 clears the whole content of the working memory 42 as indicated in FIG. 8. Thus, the programming of the composite stitch pattern An consisting of the stitch patterns A and A1–A3 (shown in FIG. 2) is completed. The sewing machine is operated under control of these series of sewing instructions stored in the sewing instruction memory 43 such that the work holding device 8 is moved to form on the workpiece the stitch pattern A at first, and then stitch patterns A1 through A3 sequentially at the respective positions which are rotated clockwise by 90°, 180° and 270° about the stitch point P1 and with respect to the stitch pattern A.

As described above, the present embodiment of the programming system permits an automatic programming of, or preparation of the sewing instructions of, the stitch patterns A1 through A3, only by preparing the sewing instructions of the stitch pattern A, such that they are disposed about a predetermined center point in circumferentially equally spaced relation with one another, that is, with equal angular spacings. Thus, not only the preparation of the sewing instructions is simplified and consequently the overall operating efficiency of the machine is improved, but also the composite stitch pattern An is very neatly and beautifully formed so that the original stitch pattern A and the additional three patterns P1–A3 are oriented about the point A1 at the positions which are circumferentially spaced at equal angular intervals.

Although the invention has been described in its preferred form with a certain degree of particularity, it is understood that the present disclosure of the preferred form may be changed in the details of construction without departing from the scope of the invention as hereinafter claimed.

Figure 12:
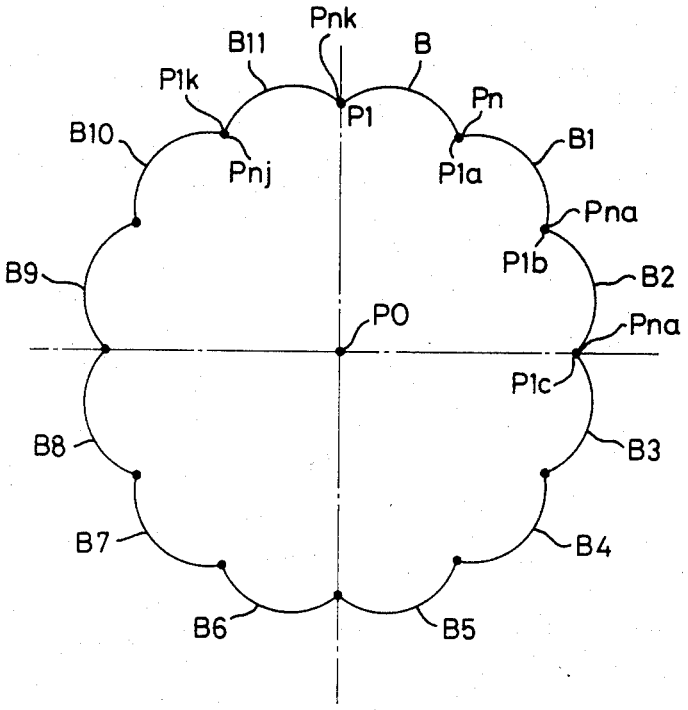
FIG. 12 is a view, similar to FIG. 2, showing a composite stitch pattern associated with a modified formation of unit stitch patterns.

For example, while the number of angular divisions is "4" in the above embodiment, it is appreciated to change the number to a desired value, for example, to "12" so that a stitch pattern B and identical stitch patterns B1–B11 are spaced in every 30° about the sewing start point P0, as illustrated in FIG. 12. In this modified embodiment, it is noted, unlike the previous embodiment, that the sewing start point P0 is not located at the stitch point P1 and therefore the sewing of the stitch pattern B is commenced only after the work holding device 8 is moved from the start point P0 to the first stitch point P1 under commands of a feed instruction. Upon completion of the sewing up to the end point or stitch point Pn of the stitch pattern B, the work holding device is once fed to the sewing start point P0 and then brought to the stitch point P1*a* of the next stitch pattern B1 from which the sewing of the pattern B1 is started. The stitch patterns B2–B11 are then sequentially formed in the same manner as indicated above.

What is claimed is:

1. A programming device for an automatic sewing machine wherein a succession of stitches defining a stitch pattern are formed through relative movements between a needle and a work holder according to a batch of sewing instructions, said programming device comprising:

memory means for storing said batch of sewing instructions prepared for forming said stitch pattern;

manual setting means for setting a desired number of angular divisions of a plane about a preset coordinate point into equal angles, said preset coordinate point being defined by first control means for preparing, based on said batch of sewing instructions and said desired number of angular divisions, another batch of sewing instructions for forming said stitch pattern at a plural number of positions corresponding to said desired number of angular divisions, said plural number of positions being circumferentially spaced about said preset coordinate point in every degrees of said equal angles; and second control means for storing said another batch of sewing instructions in said memory means.

2. A programming device according to claim 1, wherein said memory means includes a random access memory.

3. A programming system according to claim 1, wherein said manual setting means includes numeric keys.

4. A programming device according to claim 1, wherein said memory means includes a sewing instruction memory in which said batch of sewing instructions and said another batch of sewing instructions are stored, and a working memory in which data representative of said desired number of angular divisions is stored.

5. A programming device according to claim 4, wherein said sewing instruction memory is a random access memory.

6. A programming device according to claim 1, wherein said working memory is a random access memory.

* * * * *